US008571436B2

(12) United States Patent
Yamamiya

(10) Patent No.: US 8,571,436 B2
(45) Date of Patent: Oct. 29, 2013

(54) GAS TRANSFER UNIT

(75) Inventor: Masayuki Yamamiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 470 days.

(21) Appl. No.: 13/004,531

(22) Filed: Jan. 11, 2011

(65) Prior Publication Data

US 2011/0315247 A1 Dec. 29, 2011

(30) Foreign Application Priority Data

Jun. 23, 2010 (JP) ..... P2010-142534

(51) Int. Cl.
*G03G 21/20* (2006.01)
*F15C 3/00* (2006.01)

(52) U.S. Cl.
USPC ..... 399/93; 137/832; 137/804

(58) Field of Classification Search
USPC ..... 399/93, 92; 137/803, 804, 805, 825, 137/829, 832, 565.01
See application file for complete search history.

(56) References Cited

U.S. PATENT DOCUMENTS 3,465,775 A * 9/1969 Rose ..... 137/82
3,468,329 A * 9/1969 Mayer ..... 137/829
3,468,330 A * 9/1969 Adams et al. ..... 137/825
3,478,765 A * 11/1969 Kirk ..... 137/825
3,503,410 A * 3/1970 Richards ..... 137/829
3,508,579 A * 4/1970 Jones ..... 137/829
3,628,551 A * 12/1971 Mayer et al. ..... 137/832
6,112,040 A * 8/2000 Saito et al. ..... 399/93
6,792,976 B2 * 9/2004 Butera et al. ..... 137/829
2008/0038008 A1 * 2/2008 Fujita et al. ..... 399/93
2008/0063425 A1 * 3/2008 Idehara et al. ..... 399/93
2010/0183327 A1 * 7/2010 Kajiwara et al. ..... 399/93
2011/0085819 A1 * 4/2011 Akagawa ..... 399/93

FOREIGN PATENT DOCUMENTS

JP 9-54527 2/1997
JP 2007-310100 11/2007
JP 2009-192679 8/2009

* cited by examiner

*Primary Examiner* — John Rivell

(74) *Attorney, Agent, or Firm* — Sughrue Mion, PLLC

(57) ABSTRACT

A gas transfer unit includes a transfer path forming member; a gas transferring member; and a gas purifying member as defined herein, and in a case where exhaustion is performed through the first exhaust port, the transfer vanes are rotated at a first rotation number, and, in a case where exhaustion is performed through the second exhaust port, the transfer vanes are rotated at a second rotation number which is higher than the first rotation number.

6 Claims, 4 Drawing Sheets

GAS TRANSFER UNIT

CROSS-REFERENCE TO RELATED APPLICATIONS

This application is based on and claims priority under 35 USC 119 from Japanese Patent Application No. 2010-142534 filed on Jun. 23, 2010.

BACKGROUND

Technical Field

The present invention relates to a gas transfer unit.

SUMMARY

According to an aspect of the invention, there is provided a gas transfer unit which including: a transfer path forming member in which a gas transfer path through which a gas sucked from a suction port is transferred is formed, and which has a first transferring portion which extends along a first gas transfer direction, a bent portion which is connected to a downstream side of the first transferring portion in the gas transfer direction, and which is bent toward a second gas transfer direction that is inclined to the first gas transfer direction, a first exhaust port which is placed downstream from the bent portion and on an extension line of the first gas transfer direction, and through which a gas is able to be exhausted, and a second exhaust port which is placed downstream from the bent portion and on an extension line of the second gas transfer direction, and through which a gas is able to be exhausted; a gas transferring member which has rotatable transfer vanes, and which transfers a gas in the gas transfer path by rotation of the transfer vanes; and a gas purifying member which is placed correspondingly to the second exhaust port, and which purifies the gas passing through the second exhaust port, wherein, in a case where exhaustion is performed through the first exhaust port, the transfer vanes are rotated at a first rotation number, and, in a case where exhaustion is performed through the second exhaust port, the transfer vanes are rotated at a second rotation number which is higher (larger) than the first rotation number.

BRIEF DESCRIPTION OF THE DRAWINGS

Exemplary embodiments of the present invention will be described in detail based on the following figures, wherein:

FIG. 4A shows a gas flow in the case where a color printing is performed, and FIG. 4B shows the gas flow in the case where a monochrome printing is performed.

DESCRIPTION OF REFERENCE NUMERALS AND SIGNS

Figure 1:
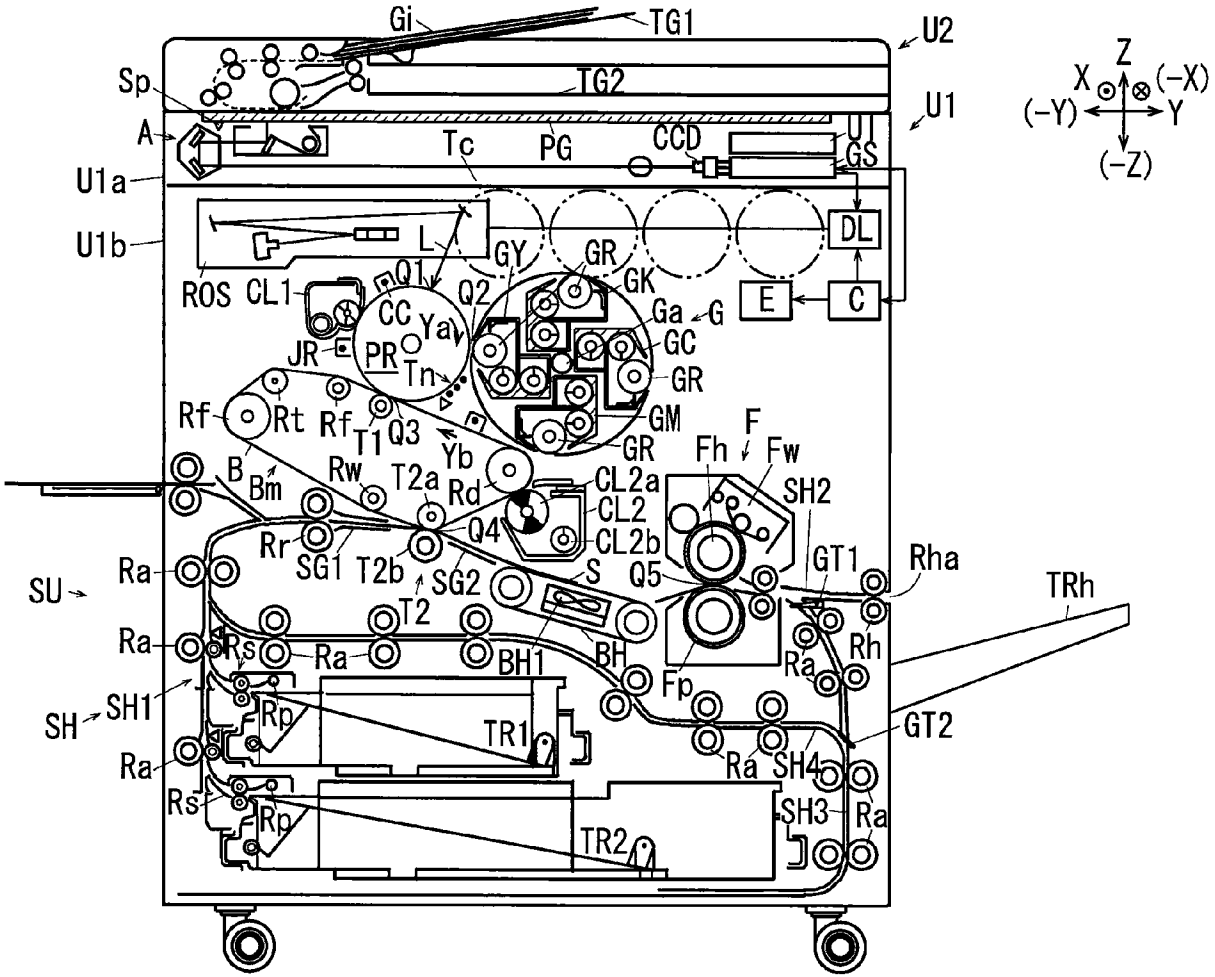
FIG. 1 is a diagram of an image forming apparatus of Example 1 of the invention.

1 . . . transfer path forming member,
(1 to 9)+C1 . . . gas transfer unit,
1*a* . . . gas transfer path,

3 . . . suction port,
7 . . . first gas transfer direction,
8 . . . first transferring portion,
9 . . . gas transferring member,
9*a* . . . transfer vane,
11 . . . second gas transfer direction,
12 . . . bent portion,
16 . . . first exhaust port,
17 . . . second exhaust port,
19 . . . gas purifying member,
C1 . . . transfer controlling unit,
S . . . medium,
U . . . image forming apparatus, and
U1*b* . . . image recording portion.

DETAILED DESCRIPTION

Next, an example which is a specific example of an exemplary embodiment of the invention will be described. However, the invention is not restricted to the following example.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "•" is written in "○" indicates the arrow which is directed from the rear of the sheet to the front, and that in which "x" is written in "○" indicates the arrow which is directed from the front of the sheet to the rear.

In the following description with reference to the drawings, illustrations of members other than those which are necessary in description are suitably omitted for the sake of easy understanding.

EXAMPLE 1

FIG. 1 is a diagram of an image forming apparatus of Example 1 of the invention.

Referring to FIG. 1, a copier U which is an example of an image forming apparatus includes a copier main unit U1, and an automatic document feeder U2 which is supported by the upper end of the copier main unit U1.

The automatic document feeder U2 has a document feed tray G1 which is an example of a document housing portion in which a plurality of documents G1 to be copied are stackingly housed. The plural documents G1 which are housed on the document feed tray G1 sequentially pass through a copy position on a platen glass PG which is an example of a transparent document table in the upper end of the copier main unit U1, and then is discharged to a document discharge try G2 which is an example of a document discharging portion. The automatic document feeder U2 is swingable with respect to the copier main unit U1 about a swing shaft which is disposed in a rear end portion, and which extends in the right and left directions. When the user is to manually place the document G1 on the platen glass PG, the automatic document feeder is upward swung.

The copier U has an operating portion UI into which the user inputs an operation command signal such as a signal for starting a copy operation.

The operating portion UI has a displaying device, and a copy start button, numeric keypad, and the like which are examples of an inputting portion.

A scanner portion U1*a* which is an example of an image reading portion is placed under the transparent platen glass PG in the upper face of the copier main unit U1, and a printer portion U1*b* which is placed under the scanner portion U1*a*, and which is an example of an image recording portion is placed under the platen glass PG. In the scanner portion U1*a*, an exposure optical system A is supported so as to be movable in the right and left directions.

The moving and stopping operations of the exposure optical system A are controlled by a detection signal of an exposure system registration sensor Sp which is an example of a position detecting member, and the system is normally stopped at the initial position shown in FIG. 1, i.e., the so-called home position.

Reflected light from the document G1 which passes through an exposure position on the upper face of the platen glass PG by the automatic document feeder U2, or a document which is manually placed on the platen glass PG impinges through the exposure optical system A on an imaging device CCD to be converted to electric signals of red: R, green: G, and blue: B.

An image processing portion IPS converts the electric signals of RGB supplied from the imaging device CCD, to image data of black: K, yellow: Y, magenta: M, and cyan: C, temporarily stores the image data, and, at a preset timing, outputs the image data as image data for forming a latent image to a laser driving circuit DL which is an example a write driving circuit.

In accordance with the input image data, the laser driving circuit DL outputs a laser driving signal which is an example of a writing signal, to a latent image forming device ROS.

A photosensitive member PR which is an example of an image carrier is placed under the latent image forming device ROS. The photosensitive member PR is rotated in the direction of the arrow Ya. The surface of the member is uniformly charged by a charging device CR, and then exposure-scanned by a laser beam L which is an example of latent-image writing light of the latent image forming device ROS, in a latent image writing position Q1, thereby forming an electrostatic latent image. In the case where a multi-color image or a so-called color image is to be formed, electrostatic latent images which correspond respectively to four color images of black: K, yellow: Y, magenta: M, and cyan: C are sequentially formed, and, in the case of a single-color image or a so-called monochrome image, only an electrostatic latent image corresponding to the image of black: K is formed.

The surface of the photosensitive member PR on which the electrostatic latent images are formed is rotatively moved to sequentially pass through a developing region Q2 and a primary transferring region Q3.

A developing device G of the so-called rotary type is placed on the right side of the photosensitive member PR. The developing device G has developing devices GK, GY, GM, GC for the four colors of black: K, yellow: Y, magenta: M, and cyan: C which are rotatively moved to the developing region Q2 in a sequential manner in accordance with rotation of a rotation shaft Ga. Each of the color developing devices GK, GY, GM, GC has a developing roll GR which is an example of a developer carrier that conveys a developer to the developing region Q2, and develops the electrostatic latent image on the photosensitive member PR passing through the developing region Q2, to a toner image which is an example of a visible image.

In accordance with consumption of the corresponding developer, a new developer is replenished from a toner cartridge Tc which is an example a developer housing container, to each of the color developing devices GK, GY, GM, GC.

Under the photosensitive member PR, an intermediate transfer belt B which is an example of the image carrier, and which is an example of an intermediate transferring member is placed. The intermediate transfer belt B is supported in a rotary movable manner by: a belt driving roll Rd which is an example of a driving member; a tension roll Rt which is an example of a tension applying member; a walking roll Rw which is an example of a meandering preventing member; an idler roll Rf which is an example of a driven member; a backup roll T2*a* which is an example of a secondary-transfer region opposing member; and a primary transfer roll T1 which is an example of a primary transferring member.

A belt supporting roll group Rd+Rt+Rw+Rf+T2*a* which is an example of an intermediate transferring member supporting member in Example 1 is configured by the rolls Rd, Rt, Rw, Rf, T2*a*. An intermediate transferring device B+Rd+Rt+Rw+Rf+T2*a*+T1 in Example 1 is configured by the intermediate transfer belt B, the belt supporting roll group Rd+Rt+Rw+Rf+T2*a*, the primary transfer roll T1, and the like.

In the case where a full-color image is to be formed, an electrostatic latent image of a first color is formed in the latent image writing position Q1, and a toner image Tn of the first color is formed in the developing region Q2. When the toner image Tn passes through the primary transferring region Q3, the toner image is electrostatically primary transferred onto the intermediate transfer belt B by the primary transfer roll T1. Thereafter, similarly, toner images Tn of second, third, and fourth colors are sequentially primary transferred onto the intermediate transfer belt B in a stacked manner, so that a full-color multi-toner image is finally formed on the intermediate transfer belt B.

In the case where a single-color or monochrome image is to be formed, only one developing device is used, and a single-color toner image is primary transferred onto the intermediate transfer belt B.

After the primary transfer, a residual toner on the surface of the photosensitive member PR is discharged by a discharging device JR, and a residual developer is removed by a photosensitive member cleaner CL1 which is an example of a photosensitive member cleaning device.

Under the backup roll T2*a*, a secondary transfer roll T2*b* which is an example of a secondary transferring member is placed so as to be movable between a position where the secondary transfer roll is separated from the backup roll T2*a*, and that where the secondary transfer roll is contacted with the backup roll. A secondary transferring region Q4 is formed by a region where the backup roll T2*a* and the secondary transfer roll T2*b* are contacted with each other.

A secondary transfer voltage the polarity of which is opposite to the charge polarity of the toners used in the developing device G is supplied from a power source circuit E to the backup roll T2*a*. The power source circuit E is controlled by a controller C which is an example of a controlling portion.

The backup roll T2*a* and the secondary transfer roll T2*b* constitute a secondary transferring device T2 in Example 1.

Under the copier main unit U1, sheet feed trays TR1, TR2 which are an example of a medium housing container are detachably supported. When a copying operation is started, a recording sheet S which is housed in one of the sheet feed trays TR1, TR2, and which is an example of a medium is picked up at a preset timing by a pickup roll Rp which is an example of a picking up member. The recording sheet S picked up by the pickup roll Rp is separated one by one by separating rolls Rs which are an example of a medium separating member, and then conveyed by a plurality of conveying rolls Ra which are an example of a medium conveying member, and which are placed in a sheet feeding path SH1 that is an example of a medium conveying path. The recording sheet S conveyed by the conveying rolls Ra is conveyed to a registration roll Rr which is an example of a transfer supplying timing adjusting member. The recording sheet S conveyed to the registration roll Rr is conveyed to the secondary transferring region Q4 through a pre-transfer sheet guide SG1 which is an example of a pre-transfer guiding member, synchronized with the timing when the primary transferred multi-toner or single-color toner image is moved to the secondary transferring region Q4.

In the secondary transferring region Q4, the secondary transferring device T2 electrostatically secondary transfers the toner image on the intermediate transfer belt B to the recording sheet S. In the intermediate transfer belt B after the secondary transfer, a residual toner is removed by a belt cleaner CL2 which is an example of an intermediate transfer cleaner. The secondary transfer roll T2*b* is cleaned by a secondary transfer cleaner CL3 which is an example of a secondary transfer cleaner.

The secondary transfer roll T2*b* and the belt cleaner CL2 are supported so as to be contactable with and separable from the intermediate transfer belt B, and, in the case where a color image is to be formed, separated from the intermediate transfer belt B until the unfixed toner image of the final color is primary transferred to the intermediate transfer belt B. The secondary transfer cleaner CL3 is moved together with the secondary transfer roll T2*b* to be separated from and contacted with the intermediate transfer belt B.

The recording sheet S to which the toner image has been secondary transferred is conveyed to a fixing device F by a post-transfer sheet guide SG2 which is an example of a post-transfer guiding member, and a sheet conveying belt BH which is an example of a medium conveying member. A suction fan BH1 which is an example of a sucking device, and which sucks air is placed inside the sheet conveying belt BH in Example 1, and sucks air through a plurality of holes (not shown) formed in the sheet conveying belt BH, whereby the recording sheet S which has passed through the secondary transferring region Q4 is allowed to be conveyed to the downstream side while sucked and held to the sheet conveying belt BH.

The fixing device F has a heating roll Fh which is an example of a heating fixing member, and a pressurizing roll Fp which is an example of a pressurizing fixing member. A heater (not shown) which functions as a heat source is placed inside the heating roll Fh. When the recording sheet S passes through a fixing region Q5 which is a region where the heating roll Fh and the pressurizing roll Fp are contacted with each other, the unfixed toner image on the surface of the recording sheet S is thermally fixed by heat of the heater and the pressurization by the pressurizing roll Fp. On the upper left side of the heating roll Fh, an oil applying device Ft which is an example of a release agent supplying device is placed upstream from the fixing region Q5 in the rotation direction, and applies oil which allows the recording sheet S to be easily peeled off from the heating roll Fh, to the surface of the heating roll Fh. On the upper right side of the heating roll Fh, a cleaning web Fw which is an example of a fixing cleaning device that cleans the surface of the heating roll Fh is placed downstream from the fixing region Q5 in the rotation direction.

The recording sheet S onto which the toner image is fixed is conveyed to a sheet discharge roller Rh which is an example of a medium discharging member, by a sheet discharging path SH2 which is an example of a medium conveying path on the downstream side of the fixing region Q5, and then discharged to the outside from a discharging port Ka which is formed in the sidewall of the copier main unit U1.

On the upstream side of the discharge roller Rh, a sheet inverting path SH3 which is an example of the medium conveying path is connected to the sheet discharging path SH2. In the connecting portion, a switching gate G1 which is an example of a switching member is disposed. The switching gate G1 selectively switches the path of the recording sheet conveyed through the sheet discharging path SH2, to either the side of discharge roller Rh or that of the sheet inverting path SH3.

A sheet circulating path SH4 which is an example of the medium conveying path is connected to the sheet inverting path SH3, and, in the connecting portion, a switching gate G2 which is an example of the switching member is disposed. The switching gate G2 allows a sheet which is conveyed from the switching gate G1 through the sheet inverting path SH3, to pass through the switching gate, and causes the recording sheet S which has once passed through the switching gate, and which is then conveyed while reversing the conveying direction, or undergoes a so-called switchback operation, to be directed toward the sheet circulating path SH4. The sheet which has been conveyed to the sheet circulating path SH4 passes through the sheet feeding path SH1, and is again conveyed to the secondary transferring region Q4 in a reversed state.

The components denoted by the reference numerals SH1 to SH4 constitute a sheet conveying path SH. The components denoted by the reference numerals Rp, Rs, Rr, Ra, SG1, SG2, and BH constitute a sheet conveying device SU.

(Description of Gas Transfer Unit)

Figure 2:
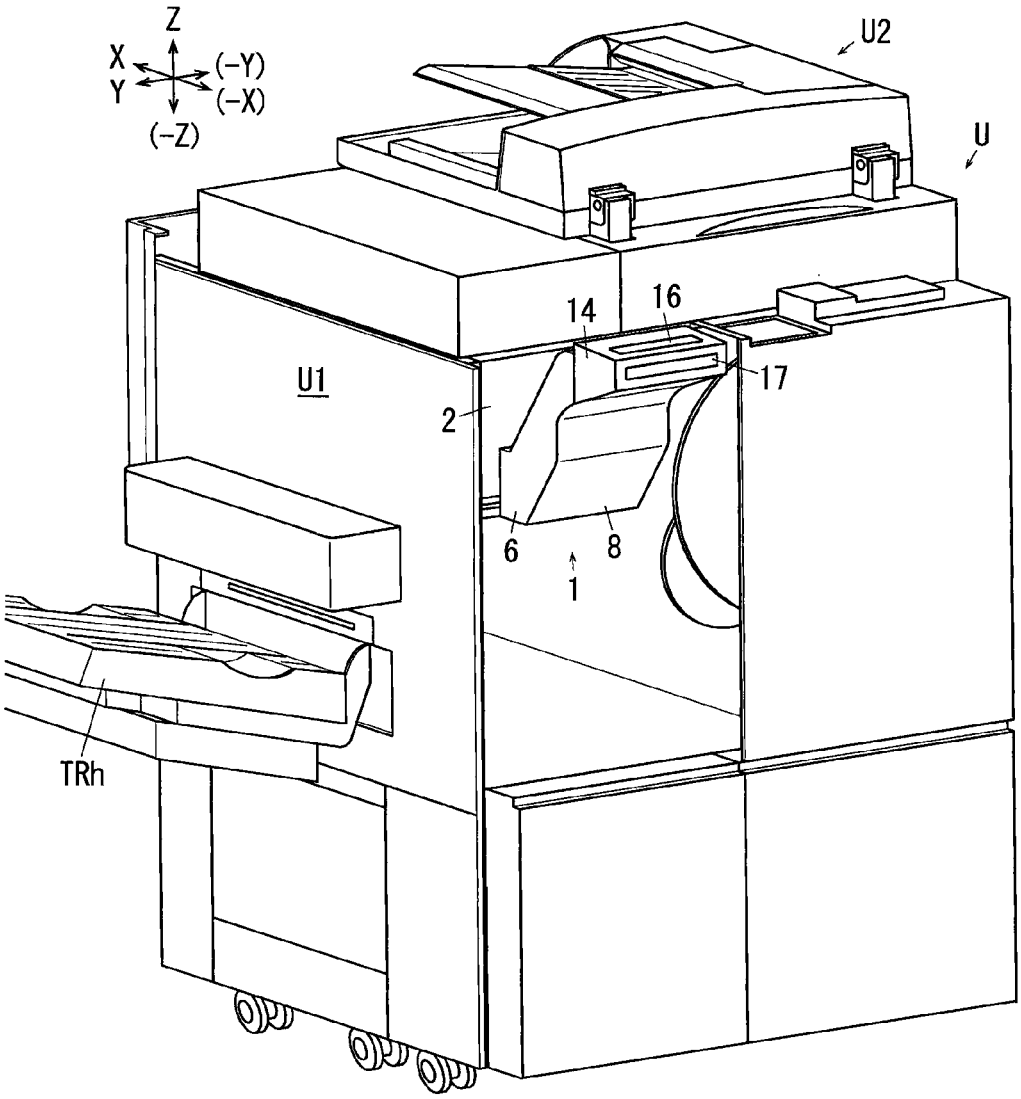
FIG. 2 is a view of a gas transfer unit in Example 1 as viewing the image forming apparatus from an obliquely rear side.

FIG. 2 is a view of the gas transfer unit in Example 1 as viewing the image forming apparatus from an obliquely rear side.

Figure 3:
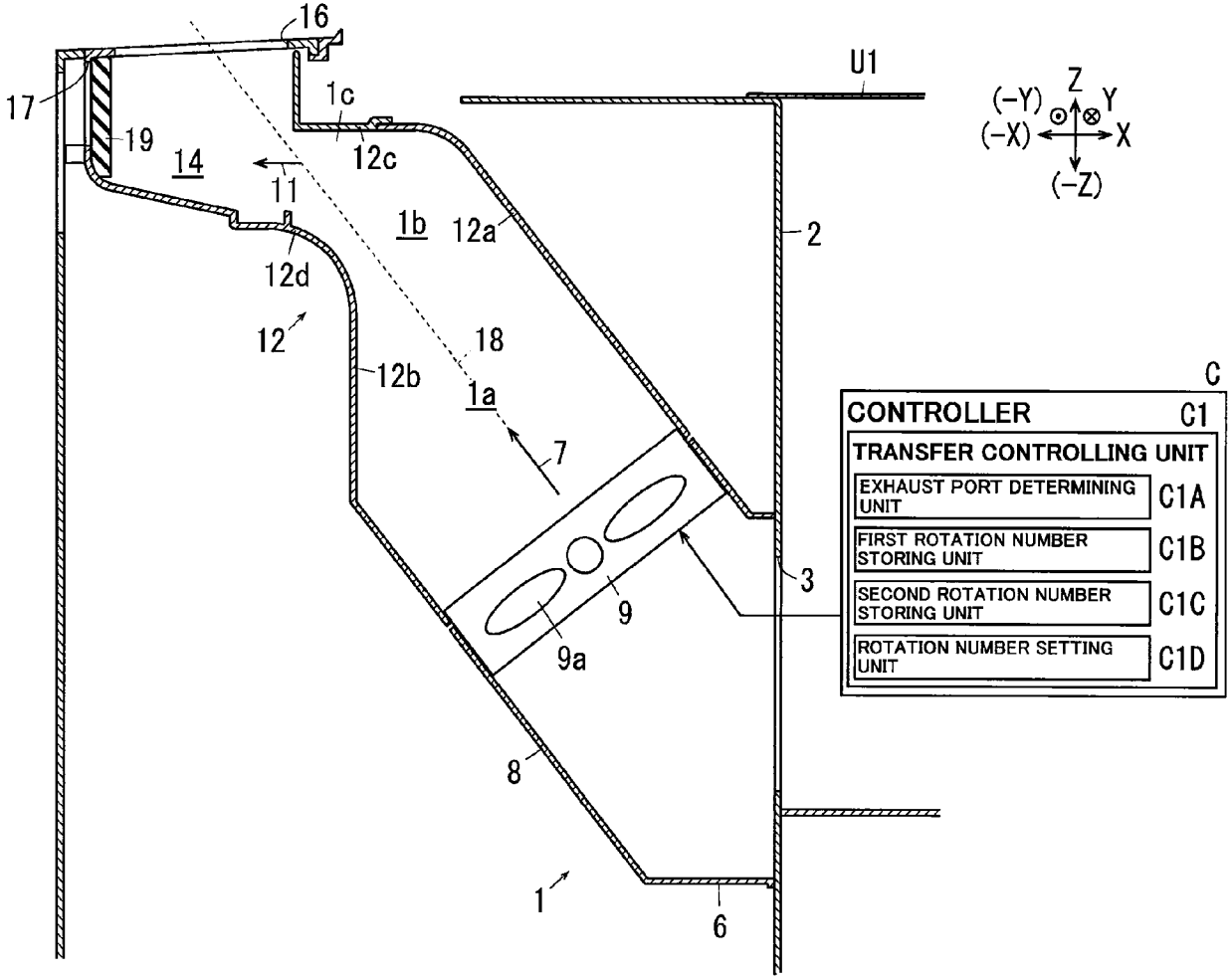
FIG. 3 is a sectional view of the gas transfer unit in Example 1 and illustrating main portions of a gas transfer path.

FIG. 3 is a sectional view of the gas transfer unit in Example 1 and illustrating main portions of a gas transfer path.

Referring to FIGS. 2 and 3, an exhaust duct 1 which is an example of a transfer path forming member is supported by a rear portion of the copier main unit U1. In the exhaust duct 1 in Example 1, an exhaust path 1*a* which is an example of the gas transfer path is formed, and upward extends from a position corresponding to an upper portion of the fixing device F. A lower end portion of the exhaust duct 1 is connected to a suction port 3 which is formed as an example of a suction port in a rear wall 2 of the copier main unit U1, and which can suck air from the fixing device F.

The exhaust duct 1 has an upstream end portion 6 which rearward extends from the suction port 3. A main duct portion 8 which is an example of a first transferring portion, which extends along a weak wind direction 7 that is an example of a first gas transfer direction, and which further extends in an obliquely upward direction as advancing more rearward is connected to the rear end of the upstream end portion 6.

A fixing exhaust fan 9 which is an example of a gas transferring member for transferring a gas is placed in the main duct portion 8. The fixing exhaust fan 9 in Example 1 has rotatable transfer vanes 9*a*, and transfers a gas along the weak wind direction 7 by rotation of the transfer vanes 9*a*.

A bent portion 12 having a shape which is continuously rearward bent from the obliquely upward direction along the weak wind direction 7, along a strong wind direction 11 that is an example of a second gas transfer direction, and that is inclined with respect to the weak wind direction 7.

Referring to FIG. 3, the bent portion 12 in Example 1 has: an upstream upper wall 12*a* which extends along the weak wind direction 7; an upstream lower wall 12*b* which extends in the gravitational direction, and in which the gap with respect to the upstream upper wall 12*a* is further narrowed as advancing more upward; a downstream upper wall 12*c* which rearward extends from the upper end of the upstream upper wall 12*a* along the strong wind direction 11; and a downstream lower wall 12*d* which is rearward bent from the upper end of the upstream lower wall 12*b*. In the bent portion 12, the exhaust path 1*a* has an upstream narrowed portion 1*b* which is between the upstream upper wall 12*a* and the upstream lower wall 12*b*, and a downstream bent exhaust portion 1*c* which is between the downstream upper wall 12*c* and the downstream lower wall 12*d*.

An exhaust portion 14 is formed in the rear end of the bent portion 12. In the exhaust portion 14, disposed are a direct exhaust port 16 which is an example of a first exhaust port, and which is formed in the upper face existing on the extension line of the weak wind direction 7 of the main duct portion 8, and a purification exhaust port 17 which is an example of a second exhaust port, and which is formed in the rear face on the extension line of the strong wind direction 11 of the bent portion 12.

The direct exhaust port 16 in Example 1 is placed on the extension line of the weak wind direction 7 extending from the fixing exhaust fan 9 so that there exists a line 18 which connects the direct exhaust port 16 to the fixing exhaust fan 9, which does not interfere with the walls 12*a* to 12*d* of the bent portion 12, and which extends along the weak wind direction 7.

A filter 19 which is an example of a gas purifying member is placed in front of the purification exhaust port 17. As the filter 19 in Example 1, a conventionally known filter which can remove a VOC and fine particles such as paper dust is used, and, for example, activated charcoal, or a filter in which the base material is configured by activated charcoal is preferably used.

Referring to FIG. 3, in the fixing exhaust fan 9 in Example 1, the rotation number or rotation speed of the transfer vanes 9*a* is controlled based on a control signal supplied from a transfer controlling unit C1 of the controller C.

The transfer controlling unit C1 in Example 1 has an exhaust port determining unit C1A, a first rotation number storing unit C1B, a second rotation number storing unit C1C, and a rotation number setting unit C1D.

The exhaust port determining unit C1A determines whether exhaustion is to be performed through the exhaust port 16 or the exhaust port 17. In Example 1, in the case where a color printing is performed as an example of the operation setting in which the fixing exhaust fan 9 is rotated at a first rotation number, the exhaust port determining unit C1A determines that exhaustion is performed mainly through the direct exhaust port 16. In the case where a monochrome printing is performed as an example of the operation setting in which the fixing exhaust fan 9 is rotated at a second rotation number, the exhaust port determining unit determines that exhaustion is performed mainly through the purification exhaust port 17. The copier U of Example 1 is set so that the monochrome printing is performed at a speed of 50 sheets per minute, and the color printing is performed at a speed of 14.5 sheets per minute.

The first rotation number storing unit C1B stores a weak-wind rotation number which is an example of the first rotation number that is the rotation number of the transfer vanes 9*a* in the case where exhaustion is performed through the direct exhaust port 16.

The second rotation number storing unit C1C stores a strong-wind rotation number which is an example of the second rotation number that is the rotation number of the transfer vanes 9*a* in the case where exhaustion is performed through the purification exhaust port 17, and that is higher than the weak-wind rotation number. As the weak-wind rotation number and the strong-wind rotation number, values which are previously measured in experiments or the like are set.

Based on a result of the determination of the exhaust port determining unit C1A, the rotation number setting unit C1D sets the rotation number of the transfer vanes 9*a* of the fixing exhaust fan 9 to the weak-wind rotation number or the strong-wind rotation number in accordance with the operation setting.

The transfer controlling unit C1 in Example 1 controls the rotation number of the fixing exhaust fan 9 at the set rotation number, to control the blown amount of a gas in the exhaust path 1*a*, i.e., the exhaust amount, thereby switching over the exhaust ports 16, 17 from which exhaustion is performed, i.e., controlling the window direction.

The members detected by the reference numerals 1 to 19, the transfer controlling unit C1, and the like constitute the gas transfer unit (1 to 19)+C1 in Example 1.

(Function of Example 1)

Figure 4B:
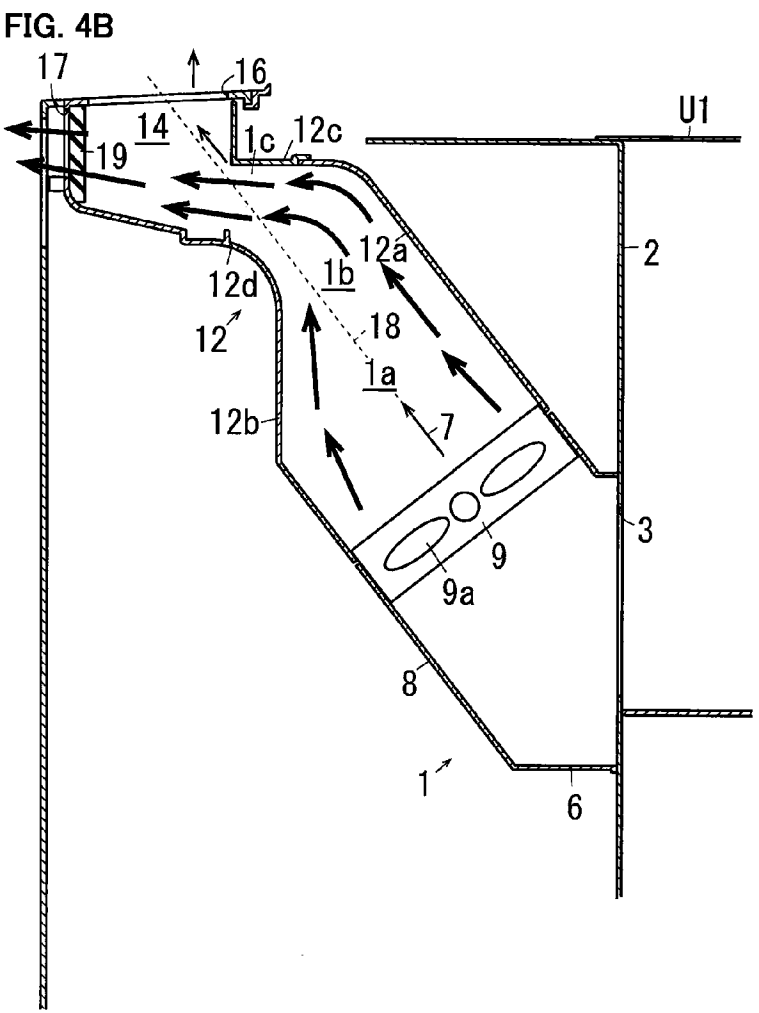
FIGS. 4A and 4B are functional diagrams of Example 1.
Figure 4A:
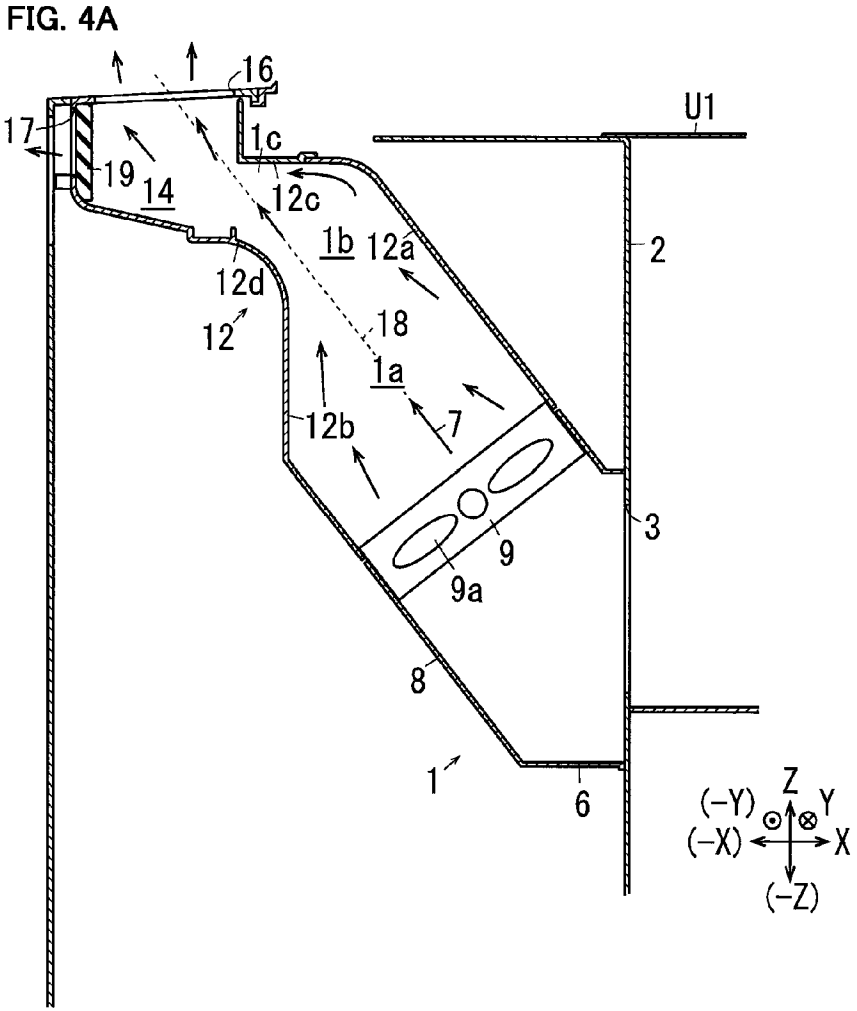

FIGS. 4A and 4B are functional diagrams of Example 1, FIG. 4A shows a gas flow in the case where the color printing is performed, and FIG. 4B shows that in the case where the monochrome printing is performed.

In the thus configured copier U of Example 1, in the case where the color printing is performed, the fixing exhaust fan 9 is slowly rotated at the weak-wind rotation number. As shown in FIG. 4A, therefore, a gas in the exhaust path 1*a* is transferred at a low speed along the weak wind direction 7, and hence the flow of the gas flowing in the exhaust path 1*a* hardly becomes turbulent, and is formed as a flow which is similar to a laminar flow. The flow of the gas is configured mainly by a flow along the weak wind direction 7 which coincides with the blow direction of the fixing exhaust fan 9. Therefore, also the flow passing through the bent portion 12 is configured mainly by a flow along the weak wind direction 7 the amount of which is larger than that of the flow along the strong wind direction 11.

Consequently, a large amount of the flow passing through the bent portion 12 is exhausted from the direct exhaust port 16 which is placed on the extension line of the weak wind direction 7, and the exhaust amount from the purification exhaust port 17 is smaller than that from the direct exhaust port 16. In Example 1, particularly, the direct exhaust port 16 is placed on the extension line of the weak wind direction 7 extending from the fixing exhaust fan 9, and at the position where the line 18 which does not interfere with the walls 12*a* to 12*d* of the bent portion 12 exists, and hence the gas from the fixing exhaust fan 9 is susceptible to flow into the direct exhaust port 16.

In the case where the monochrome printing is performed, by contrast, the fixing exhaust fan 9 is rapidly rotated at the strong-wind rotation number. As shown in FIG. 4B, therefore, a gas in the exhaust path 1*a* is transferred at a high speed. Therefore, the flow of the gas flowing through the exhaust path 1*a* easily becomes turbulent when the gas flows over the interface areas between the upstream walls 12*a*, 12*b* of the bent portion 12 and the downstream walls 12*c*, 12*d*, and, in the outlet of the bent exhaust portion 1*c*, easily flows in the strong wind direction 11 along the downstream walls 12*c*, 12*d*. In the bent portion 12 in Example 1, particularly, the cross-sectional area perpendicular to the flow in the exhaust path 1*a* is reduced in the upstream narrowed portion 1*b* which is directed toward the bent exhaust portion 1*c*, and the gas is compressed, so that the flow in the strong wind direction 11 along the downstream walls 12*c*, 12*d* is easily formed in the outlet of the bent exhaust portion 1*c*.

Consequently, a large amount of the flow passing through the bent portion 12 is exhausted from the purification exhaust port 17 which is placed on the extension line of the strong wind direction 11, and the exhaust amount from the direct exhaust port 16 is smaller than that from the purification exhaust port 17.

In the copier U of Example 1, in the color printing in which the print number per unit time is relatively small, the amount of a VOC generated in the fixing device F is relatively small. In the case where the amount of a VOC does not exceed the legal limit even when exhaustion is performed without passing through the filter 19, therefore, the fixing exhaust fan 9 is slowly rotated, and exhaustion is performed through the direct exhaust port 16. In the monochrome printing in which the print number per minute is relatively large, the amount of a VOC generated in the fixing device F is relatively large, the fixing exhaust fan 9 is rapidly rotated, whereby the gas flow is caused to pass through the filter 19 to remove the VOC, and then exhausted from the purification exhaust port 17.

In the copier U of Example 1, the rotation number of the fixing exhaust fan 9 is controlled so that, in the case where the gas flow is required to pass through the filter 19, the gas flow passes through the filter 19, and, in the case where the gas flow is not required to pass through the filter 19, the gas flow does not pass through the filter 19. As compared with the conventional configuration where a gas flow always passes through a filter, therefore, a gas which passes through the filter 19 is controlled by the relatively simple configuration in which the rotation number of the fixing exhaust fan 9 is controlled, and deterioration of the filter 19 is suppressed, with the result that the life of the filter 19 is prolonged, and the replacement frequency is reduced.

In the copier U of Example 1, the temperature of the exhaust from the fixing device F having the heater which functions as a heat source is higher than the room temperature, and hence the exhaust is easily caused to be upward moved by air convection. In Example 1, the direct exhaust port 16 is placed in the upward side in the gravitational direction. In the case where the gas is transferred at a low speed, therefore, the gas is susceptible to be efficiently exhausted from the direct exhaust port 16 by using also the convection in addition to the transfer by the fixing exhaust fan 9.

(Modifications)

Although, in the above, the example of the invention has been described in detail, the invention is not restricted to the example. Various modifications are enabled within the scope of the spirit of the invention set forth in the claims. Modifications (H01) to (H09) of the invention will be exemplified.

(H01) Although, in the example, the copier U has been described as an example of the image forming apparatus, the invention is not restricted to this. The invention may be applied to a printer, a facsimile apparatus, a multi-function apparatus having a plurality of functions of these apparatuses, or the like. The invention is not restricted to a multi-color image forming apparatus, and may be configured by a single-color or so-called monochrome image forming apparatus. Although the developing device of the rotary type has been exemplified as the developing device G, the invention is not restricted to this. The invention can be applied to a configuration in which an image carrier, a charging device, a developing device, a latent image forming device, and like are provided for each color, or a so-called tandem image forming apparatus, a so-called retract type image forming apparatus having a configuration where each of four developing devices is contacted with and separated from one image carrier, or an image forming apparatus of any conventionally known type.

(H02) Although, in the example, the configuration where the fixing exhaust fan 9 which is an example of the gas transferring member is placed in the exhaust path 1*a* has been exemplified, the invention is not restricted to this. The fixing exhaust fan may be placed inside the main unit of the image forming apparatus, or placed in the bent portion 12.

(H03) In the example, the suction port 3 is placed in the upstream end of the main duct portion 8. Alternatively, a configuration where a plurality of ducts are connected to the area between the suction port 3 and the main duct portion 8, or a configuration where a duct from a member other than the fixing device F joins may be employed. A further configuration where another duct joins the main duct portion 8 may be possible.

(H04) Although, in the example, the configuration related to the exhaust path 1*a* from the fixing device F has been exemplified, the invention is not restricted to this. The configuration of Example 1 may be applied to a gas transfer path in a member other than the fixing device F. The invention can be applied also to, for example, a gas transfer unit for exhausting ozone which is easily generated in the vicinity of the charging device CR, and a scattered developer.

(H05) In the example, the exemplified specific values and the like can be adequately changed in accordance with the design, the specification, or the like.

(H06) Although, in the example, the configuration where the rotation number of the fixing exhaust fan 9 is changed in the color printing and the monochrome printing has been exemplified, the invention is not restricted to a configuration where the change is performed depending on the operation setting such as the color printing or the monochrome printing, or a so-called mode. A configuration where the rotation number is changed in accordance with the operation setting such as the kind of the used medium, the resolution of the image, the density of the printed image, or the like, or a mode, parameters, and the like may be employed. Specifically, a configuration may be possible where, in the case where the medium kind is "cardboard", when the medium is conveyed at a lower speed than that of the case of "plain paper", the fixing exhaust fan 9 is set to a low rotation number, and, in the case where the medium kind is "plain paper", the fixing exhaust fan is set to a high rotation number. Alternatively, in the case where the density of the image is high, the fixing exhaust fan may be rotated at a higher speed than that of the case of a low density, or, in the case where the resolution is high, the fixing exhaust fan may be rotated at a higher speed than that in the case where the resolution is low.

(H07) In the example, the configuration where the direct exhaust port 16 is placed in the upward side in the gravitational direction and air convection is used is preferred. Alternatively, in accordance with the design or the like, the positions of the direct exhaust port 16 and the purification exhaust port 17 may be set to any direction, such as downward or obliquely downward in the gravitational direction.

(H08) In the example, the configuration is preferred where the direct exhaust port 16 is placed on the extension line of the weak wind direction 7 extending from the fixing exhaust fan 9 so that there exists the line 18 which does not interfere with the walls 12*a* to 12*d* of the bent portion 12. Even when the line 18 does not exist, the bend degree and length of the bent portion 12 can be arbitrarily changed as far as the increase/decrease of the blow amount in the exhaust port through which a gas passes can be controlled in accordance with the control of the rotation number of the fixing exhaust fan 9.

(H09) Although, in the example, the configuration where the rotation number is switched in two steps or the high and low rotation numbers has been exemplified, the invention is not restricted to this. The ratio of a gas which is allowed to pass through the filter, to a gas which is not allowed to pass is controlled by a configuration where the rotation number is controlled and changed in three or more steps or continuously.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A gas transfer unit comprising:

a transfer path forming member in which a gas transfer path through which a gas sucked from a suction port is transferred is formed, and which comprises: a first transferring portion which extends along a first gas transfer direction; a bent portion which is connected to a downstream side of the first transferring portion in the gas transfer direction, and which is bent toward a second gas transfer direction that is inclined to the first gas transfer direction; a first exhaust port which is placed downstream from the bent portion and on an extension line of the first gas transfer direction, and through which a gas is able to be exhausted; and a second exhaust port which is placed downstream from the bent portion and on an extension line of the second gas transfer direction, and through which a gas is able to be exhausted;

a gas transferring member which has rotatable transfer vanes, and which transfers a gas in the gas transfer path by rotation of the transfer vanes; and a gas purifying member which is placed correspondingly to the second exhaust port, and which purifies the gas passing through the second exhaust port, wherein, in a case where exhaustion is performed through the first exhaust port, the transfer vanes are rotated at a first rotation number, and, in a case where exhaustion is performed through the second exhaust port, the transfer vanes are rotated at a second rotation number which is higher than the first rotation number.

2. The gas transfer unit according to claim 1, wherein a gas from a heat source is sucked into the suction port, the first exhaust port is placed in an upward side in a gravitational direction, and able to exhaust a gas in an upward direction, and the second exhaust port is able to exhaust a gas in a horizontal direction.

3. The gas transfer unit according to claim 1, wherein the gas transferring member is placed in the first transferring portion, an inner face of the bent portion does not interfere with a line extending from the gas transferring member in the first gas transfer direction, and the first exhaust port is placed on the line.

4. The gas transfer unit according to claim 2, wherein the gas transferring member is placed in the first transferring portion, an inner face of the bent portion does not interfere with a line extending from the gas transferring member in the first gas transfer direction, and the first exhaust port is placed on the line.

5. A gas transfer unit comprising:

a transfer path forming member in which a gas transfer path through which a gas sucked from a suction port is transferred is formed, and which has: a first transferring portion which extends along a first gas transfer direction; a bent portion which is connected to a downstream side of the first transferring portion in the gas transfer direction, and which is bent toward a second gas transfer direction that is inclined to the first gas transfer direction; a first exhaust port which is placed downstream from the bent portion and on an extension line of the first gas transfer direction, and through which a gas is able to be exhausted; and a second exhaust port which is placed downstream from the bent portion and on an extension line of the second gas transfer direction, and through which a gas is able to be exhausted;

a gas transferring member which has rotatable transfer vanes, and which transfers a gas in the gas transfer path by rotation of the transfer vanes; and a gas purifying member which is placed correspondingly to the second exhaust port, and which purifies the gas passing through the second exhaust port, wherein a setting where the transfer vanes are rotated at a first rotation number and another setting where the transfer vanes are rotated at a second rotation number which is higher than the first rotation number are switched over in accordance with an operation setting of image formation.

6. The gas transfer unit according to claim 5, wherein, in a case of an operation of forming a multi-color image, the operation setting is a setting where the transfer vanes are rotated at the first rotation number, and, in a case of an operation of forming a single-color image, the operation setting is a setting where the transfer vanes are rotated at the second rotation number.

* * * * *